United States Patent [19]

Uetrecht et al.

[11] 4,389,914

[45] Jun. 28, 1983

[54] CHORD IDENTIFICATION SYSTEM FOR ELECTRONIC MUSICAL INSTRUMENTS

[75] Inventors: Dale M. Uetrecht, Colerain Township, Hamilton County, Ohio; Carlton J. Simmons, Jr., Florence, Ky.

[73] Assignee: Baldwin Piano & Organ Company, Cincinnati, Ohio

[21] Appl. No.: 275,082

[22] Filed: Jun. 18, 1981

[51] Int. Cl.[3] ..... G10H 1/38; G10H 7/00

[52] U.S. Cl. ..... 84/1.01; 84/1.17; 84/445; 84/DIG. 22

[58] Field of Search ..... 84/1.01, 1.03, 1.17, 84/1.24, DIG. 12, DIG. 22, DIG. 25, 445

[56] References Cited

U.S. PATENT DOCUMENTS 4,072,078 2/1978 Shallenberger et al. ..... 84/1.03

4,300,430 11/1981 Bione et al. ..... 84/1.01

*Primary Examiner*—Stanley J. Witkowski

*Attorney, Agent, or Firm*—Kirkland & Ellis

[57] ABSTRACT

The present invention relates to a process and apparatus for use in musical instruments. In particular, the invention is useful for identifying a chord played on a keyboard of a musical instrument, such as the accompaniment manual of an electronic organ, and for identifying the root and the type of chord being played. Pursuant to the invention, a microprocessor used in conjunction with the instrument selectively causes the associated circuitry of the pedal and/or accompaniment keyboard of the musical instrument to play automatically in an appropriate octave either the identified root or a sequence of notes which is compatible with the identified root and chord. A pedal override feature is also provided which overrides the chord identification invention when the musician plays one or more pedal notes.

6 Claims, 5 Drawing Figures

| Standard Chord Name | C-Chord | C (ROOT) | C# | D | D# (Minor Third) | E (Third) | F (Fourth) | F# | G (Fifth) | G# | A (Sixth) | A# (Minor Seventh) | B (Seventh) |
|---|---|---|---|---|---|---|---|---|---|---|---|---|---|
| MAJOR TRIAD | C | 1 | 0 | 0 | 0 | 1 | 0 | 0 | 1 | 0 | 0 | 0 | 0 |
| MINOR TRIAD | $C_M$ | 1 | | | 1 | | | | 1 | | | | |
| AUGMENTED TRIAD | $C_T$ | 1 | | | | 1 | | | | 1 | | | |
| DOMINANT SEVENTH | $C_7$ | 1 | | | | 1 | | | 1 | | | | |
| MINOR SEVENTH | $C_M7$ | 1 | | | 1 | | | | 1 | | | 1 | |
| MAJOR SEVENTH | $C_{MA}7$ | 1 | | | | 1 | | | 1 | | | | 1 |
| DIMINISHED SEVENTH | $C_{dim}$ | 1 | | | 1 | | | 1 | | | 1 | | |
| MAJOR SIXTH | $C_6$ | 1 | | | | 1 | | | 1 | | 1 | | |
| MINOR SIXTH | $C_{M6}$ | 1 | | | 1 | | | | 1 | | 1 | | |
| DOMINANT NINTH | $C_9$ | 1 | | 1 | | 1 | | | 1 | | | 1 | |
| DIMINISHED NINTH | C-9 | 1 | 1 | | | 1 | | | 1 | | | 1 | |

CHORD IDENTIFICATION SYSTEM FOR ELECTRONIC MUSICAL INSTRUMENTS

BACKGROUND AND SUMMARY OF THE INVENTION

The present invention relates to a process and apparatus for use in musical instruments. In particular, the invention identifies a chord played on a keyboard of a musical instrument, such as the accompaniment manual of an electronic organ, and identifies the root of the chord and the type of chord being played. The pedal circuitry (which may be responsive to either the pedal keys or manual stops controlling pedal tone sequences) of the musical instrument is then caused to play automatically either this root or a sequence of notes which is compatible with the identified root without actual playing of the pedals. The sequence can alternatively be produced automatically in the circuitry of the accompaniment division, if desired. In addition, an override feature is provided which overrides the chord identification feature when one or more pedal notes are played by the musician.

In an eletronic musical instrument with a pedal keyboard, it is desirable to have automatic pedal features. In previous instruments, systems have been developed which respond to playing with only one finger on the accompaniment manual. From this single note a complete accompaniment chord is constructed and the selected note or an octavely lower note is also used as the pedal note. A minor touch bar may also be provided to change from a major to a minor chord. In such systems, it is common for the pedal sequences to include the minor third when called for by the minor touch bar. In this way the pedal pattern is always musically correct and compatible with the accompaniment chord. These systems allow the beginning musician to obtain complete accompaniment chords and an automatic pedal sequence by playing only one finger on the accompaniment keyboard. However, if the musician wants to advance beyond one finger playing he is immediately faced with playing his own pedal and constructing his own chord.

Certain attempts have been made to overcome the foregoing limitations found in available musical instruments. For example, U.S. Pat. No. 4,248,118 discloses an apparatus for deriving the chord type and root of a chord being played. That system, however, operates on the principle of storing in digital memory the key patterns identifying all possible chords and chord combinations for comparison to the chord being played, or a rotated version of the same. When a match is found, the address of the matching stored pattern indicates the chord type. The chord being played is also rotated before the matching process commences in order to standardize the transposition. The number of rotations needed before a match occurs identifies the root of the chord. As one skilled in the art will appreciate, the number of key patterns identifying all possible chords and chord combinations is large. Because this system stores such patterns in digital memory, the chord identification function would appear to require a significantly large memory capability.

Unlike U.S. Pat. No. 4,248,118, the present invention performs the chord identification function through a logical sequence of tests which determine the existence of root intervals, the number of notes and the nature of the chord (e.g., whether the chord is a major or minor chord). The simplicity of the present invention allows chord identification of musically preferred chords based on the lowest note played without dedicating substantial memory space to that function.

Accordingly, it is a principal object of the present invention to provide a process which identifies the root and the type of a chord being played by the musician.

It is another object to provide a process adapted to cause the pedal or accompaniment circuitry of the musical instrument to play automatically the identified root or a sequence of notes which is compatible with the identified root.

It is yet another object to provide an override function whereby the musician may play the pedal keyboard thereby overriding the automatic chord identification system.

Yet another object is to provide a microprocessor adapted to implement the process of the present invention.

DESCRIPTION OF THE DRAWINGS

These and other objects, advantages and features of the present invention will appear for purposes of illustration, but not of limitation, in connection with accompanying drawings wherein like numbers refer to like parts throughout and wherein.

DETAILED DESCRIPTION OF THE PREFERRED EMBODIMENTS

The present invention relates to a process and apparatus for use in musical instruments. In particular, the invention identifies a chord played on a manual keyboard of a musical instrument, such as the accompaniment manual of an electronic organ, and identifies the root of the chord and the type of chord being played. The pedal circuitry (which may be responsive to either the pedal keys or manual stops controlling pedal tone sequences) of the musical instrument is then caused to play automatically either this root or a sequence of notes which is compatible with the identified root without actual playing of the pedals.

The basic operation of a microprocessor controlled organ system in accordance with the present invention is as described below. The microprocessor includes a random access memory, a portion of which is used to store information regarding the identity of notes to be sounded by the organ. The microprocessor stores a "1" in its memory at the location allocated to a particular note if the key on the keyboard corresponding to that note is actuated, and a "0" in the memory location corresponding to each key on the keyboard which is not actuated. In addition, the microprocessor stores in defined locations a "1" or a "0" representing the ON/OFF state of various stop and control tabs. There are as many as 61 accompaniment keys, 61 solo keys, 32 pedal keys and typically 50 to 100 stop and control tabs, or switches, available on most electronic organs. The precise number of such keys and tabs is immaterial to the present invention.

The status of the various key switches of the keyboard (as well as the status of stop control switches, pedal switches of the pedal keyboard and function tab switches) is ascertained by addressing the location of these switches, and loading this information into designated portions of the memory. This operation is performed under the control of the microprocessor, and at intervals selected so as to eliminate any audible delay in the response of the instrument to a change in the status of a key or switch. Programmable signal generators are then assigned to produce tones corresponding to notes to be sounded (i.e., the notes played plus the notes to be filled-in) and these tones are transmitted to an appropriate output system.

Figure 1:
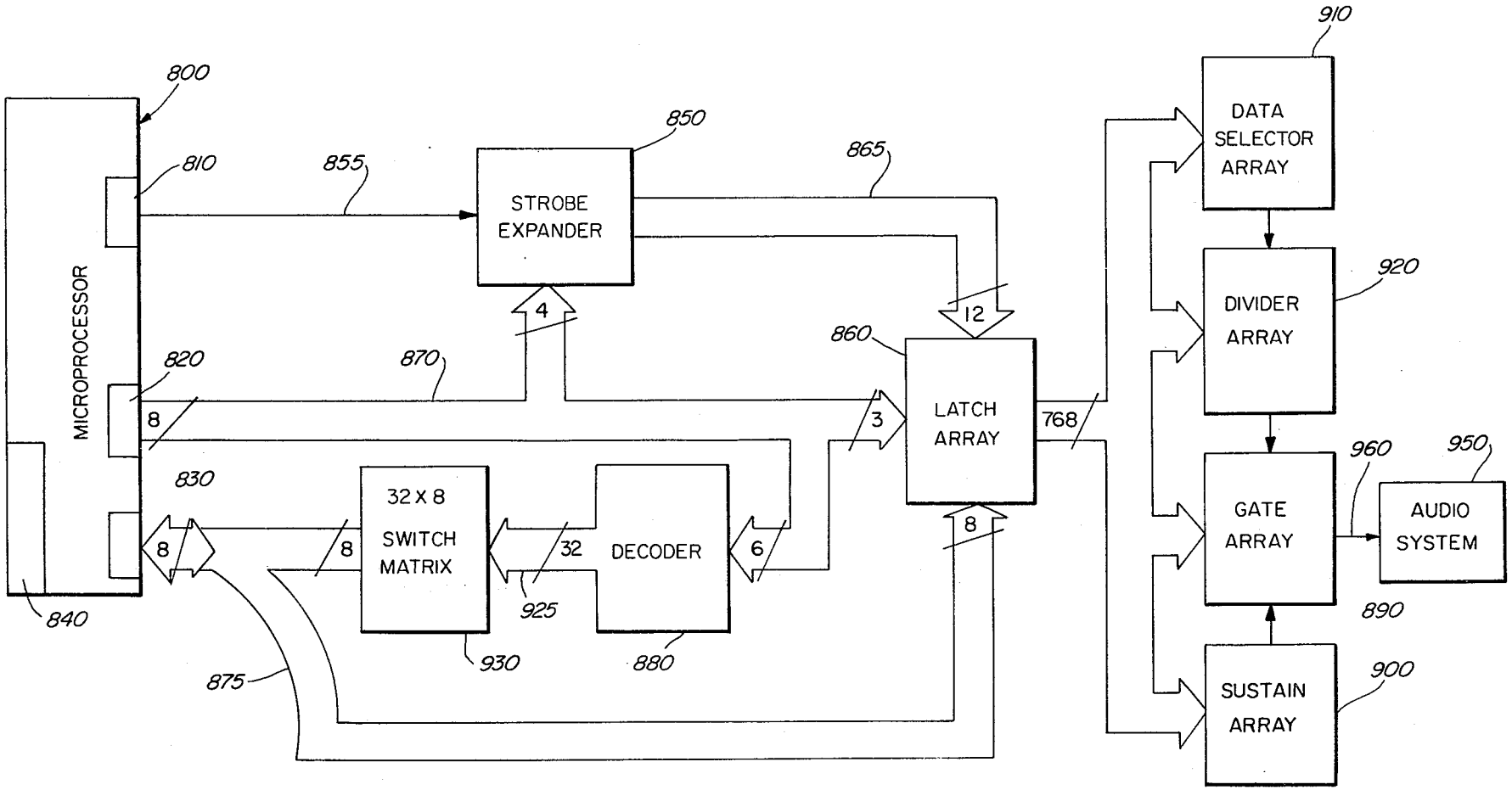
FIG. 1 is a block diagram of a preferred form of musical instrument in which the process of the present invention can be employed.

In a typical microprocessor controlled organ system, as shown in FIG. 1, microprocessor 800 includes a strobe 810, an output port 820, a bi-directional input-/output port ("I/O port") 830, and a random access memory 840. For clarity, other conventional features of the microprocessor 800 are not shown. Strobe 810 of microprocessor 800 is connected to strobe expander 850 by a line 855. Strobe expander 850 is connected in turn to latch array 860 via 12 lines 865. Output bus 870 connects the output port 820 of microprocessor 800 to the rest of the organ system via the eight lines which comprise output bus 870 as follows: four lines of output bus 870 are connected to strobe expander 850; three lines of output bus 870 are connected to latch array 860; and six lines of output bus 870 are connected to decoder 880. Five of the six lines connected to decoder 880 are also connected to strobe expander 850 or latch array 860. However, no ambiguity arises between the strobe expander 850 and latch array 860 are only addressed during operations affecting the output system (i.e., gate array 890, sustain array 900, data selector array 910 and divider array 920) whereas the decoder 880 is only addressed when the status of the switches in switch matrix 930 is being read into the memory 840 of microprocessor 800. As depicted in FIG. 1, the switch matrix 930 is a 32×8 matrix, i.e., 256 possible switch positions.

Decoder 880 is connected to switch matrix 930 by decoder bus 925 which comprises 32 lines which are addressed sequentially by decoder 880. Each of the 32 lines 925 addresses eight switches of the switch matrix and the status of the 32 sets of eight switches per set is thereby read into microprocessor 800 via the eight lines of I/O bus 875, as a series of 32 8-bit words. In this manner, the microprocessor 800 scans the condition of each of the switches in the switch matrix 930. The switch matrix 930 includes a switch for each key of the keyboard(s) (not shown) as well as each of the stops (i.e., voice selection controls—not shown) and function tabs (e.g., automatic fill-in, automatic chording, and sustain—not shown) and each of the pedals on the pedal keyboard. This information is read into the random access memory 840 of the microprocessor 800 for further processing in accordance with the instructions called for by the switches. The microprocessor then uses the information stored in memory for the chord identification ("CID"). As will be appreciated, repetitive scanning of the keys through decoder 880 permits a determination of any changes to the keys being played by comparing the "current" state of the respective keys to that stored in temporary memory. Once this determination is made, note assignments and generator allocations may be made based upon the new state of the keys and switches and signals may be generated for the synthesis of audible sounds by audio system 950.

It will be noted that the foregoing assignment and allocation function is fully and completely described in U.S. patent application Ser. No. 163,409, filed on June 26, 1980, entitled "Electronic Organ Having an Improved Tone Generator System," and assigned to the assignee of the present invention; that application (hereinafter referred to as the "Tone Generator System Application") is incorporated herein by reference for all purposes.

After assignments and allocations have been made, solo ("SOLO") and accompaniment ("ACC") keyswitch information is used by the microprocessor 800 to compute SOLO FILL, or harmony, information. The SOLO FILL is fully and completely described in U.S. patent application Ser. No. 158,585, filed on June 6, 1980, entitled "Harmony Generator for Electronic Organ", and assigned to the assignee of the present invention; that application (hereinafter referred to as the "Harmony Generator Application") is incorporated herein by reference for all purposes.

After the foregoing steps have been performed, the CID system 190 (see FIG. 2) of the present invention may be initiated to determine the root of the chord being played on the accompaniment manual keyboard and the chord type, i.e., major, minor or flatted fifth, and to cause automatic playing of either the identified root or a sequence of notes musically compatible with this root.

Figure 2:
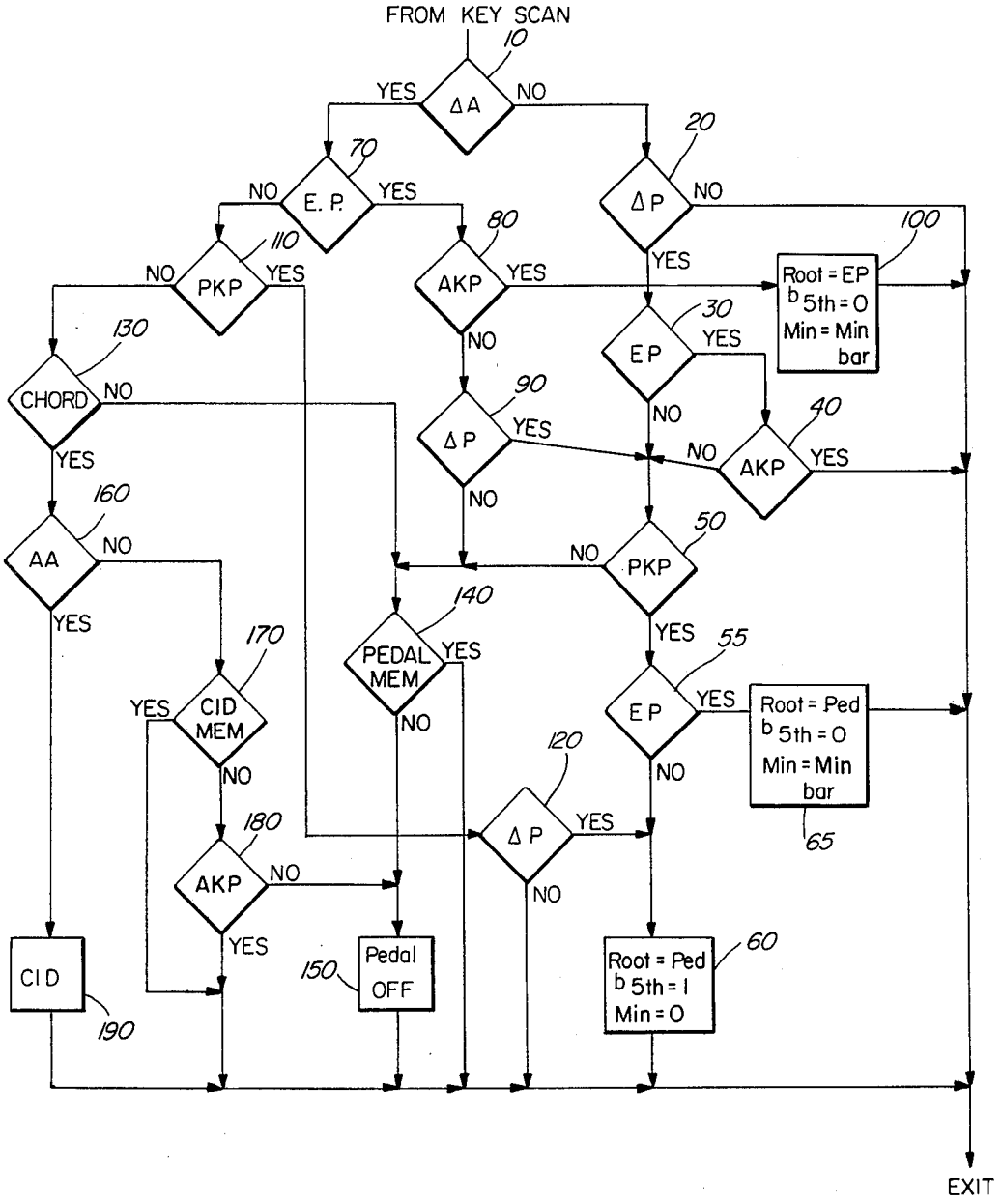
FIG. 2 is a flow chart illustrating the manner in which the microprocessor determines under what circumstances the present invention will be activated.

Referring to FIG. 2, the sequence of events occurring after SOLO, ACC and pedal scanning has occurred is depicted.

It will be appreciated that the microprocessor 800 of the present invention includes an array of memory bits which are set/reset during the playing of the musical instrument. For present purposes these memory bits include those relating to the accompaniment keys of the manual keyboard, the solo keys of the manual keyboard, the pedals of the pedal board and various tabs which control such functions as added harmony, etc. Thus, when the musical instrument is being played, the memory bits of the microprocessor 800 are set/reset whenever the musician changes notes, tabs, etc.

By comparing the state of the switches to the state of the memory bits each time that the switch matrix 930 is scanned, it is possible to determine which of the switches have been actuated/released since the last scanning sequence. And because such repetitive scanning occurs very rapidly, i.e., on the order of milliseconds, it may be said that the state of any of the switches of the switch matrix 930 is instantaneously determined and, accordingly, any change in the state of any of the switches is also known. Corresponding flags are thus set/reset to reflect these changes and to identify the status of the keyboards.

In keeping with the present invention, the change of state of the switches of switch matrix 930 is used to initiate the CID process. Thus, these switches are continuously tested/retested. Table I generically identifies those memory bits which are set/reset based upon the results of the change of state of the switches of switch matrix 930.

TABLE I

| Keyboard status Flags | Brief Description |
|---|---|
| Δ A | Change in accompaniment keys |
| Δ S | Change in solo keys |
| Δ P | Change in Pedal keys |
| SA | Added solo keyswitch |
| AA | Added accompaniment keyswitch |
| AKP | Accompaniment key being played |
| SKP | Solo key being played |
| PKP | Pedal key being played |
| EP | Easy-play mode being activated |
| CHORD | CID mode being activated |

As noted in FIG. 2, test 10 checks the state of the ΔA flag to ensure that the pedal root does not change unless there has been a change in accompaniment keys. If there has been no change in accompaniment keys since the last key scan routine, test 10 is negative and the ΔP flag is checked by test 20. If there have been no changes to either the accompaniment or the pedal keyboards since the last key scan there would be no change in the pedal root; test 20 would then be negative and the program would branch to EXIT. If test 20 is positive, test 30 checks the state of the easy play ("EP") flag. If the EP flag is ON (i.e., the test is positive), test 40 checks the AKP flag to determine if any accompaniment key is being played. If test 40 is positive, the program branches to EXIT.

It should be noted in this sequence that the EP system described in U.S. patent application Ser. No. 40,107, filed on May 18, 1979, U.S. Pat. No. 4,292,874, issued on Oct. 6, 1981, entitled "Automatic Control Apparatus for Chords and Sequences," and assigned to the assignee of the present invention, (hereinafter referred to as the "Chords and Sequences Patent") has priority over the pedal functions of the present invention. Thus, when the EP system referred to in the Chords and Sequences Application is being utilized, the ON state of the ΔP and AKP flags is effectively ignored. In other words, the EP system disclosed in the Chords and Sequences Patent and the CID system disclosed herein are mutually exclusive. The Chords and Sequences Patent, referred to above, is incorporated herein by reference for all purposes.

In the event that either (i) test 30 establishes that the EP flag is ON and test 40 establishes that the AKP flag is OFF (i.e., the test is negative) or (ii) that the EP flag is OFF, test 50 checks the state of the PKP flag. If this flag is ON, i.e., pedal keys are being played, the EP flag is again checked in test 55.

If test 55 is negative, i.e., the EP flag is OFF, the pedal key being played is stored in memory as the pedal root by function 60. In addition, a minor flag latch is set to 0 and a flatted fifth flag is set to 1. However, if test 55 establishes that the EP flag is ON, the pedal key being played is stored in memory as the root, a flatted fifth flag is set to 0 and a minor flag is set to the minor bar by function 65. Thereafter, the program branches to EXIT and the next sequential instruction is taken.

If test 10 establishes that the ΔA flag is ON, a check of the state of the EP flag is made by test 70. If the EP flag is ON, test 80 determines the state of the AKP flag. If this flag is ON, function 100 sets the pedal root equal to the EP note being played and the major/minor nature of the chord type is directly determined. In addition, the flatted fifth flag is set equal to 0 and the minor flag is set equal to the minor bar. Thereafter, the program branches to EXIT.

On the other hand, if test 70 establishes that the EP flag is OFF, a check of the PKP flag is made by test 110. Test 110 determines if a pedal key is being played. If test 110 is positive, (i.e., a pedal key is being played), the CID system is inhibited and test 120 checks the state of the ΔP flag. If the ΔP flag is ON, function 60 stores the pedal key being played as the pedal root. Function 60 also sets the minor flag equal to 0 and the flatted fifth flag equal to 1. Thereafter, the program branches to EXIT. However, if the test 120 establishes that the ΔP flag is OFF, the program branches to EXIT.

As noted, test 110 checks the state of the PKP flag, if that flag is OFF, test 130 checks the state of the CHORD tab. If the CHORD tab is OFF, test 140 checks the state of the PEDAL MEMORY tab; if the PEDAL MEMORY tab is ON, the program branches to EXIT. If the PEDAL MEMORY tab is OFF, function 150 stores no key played in memory and the program branches to EXIT. Thus, it will be noted that if test 140 is negative, no pedal note is sounded.

As previously noted, test 80 checks the state of the AKP flag. If that flag is OFF, the ΔP flag is checked by test 90. If that test establishes that the ΔP flag is ON, the program branches to test 50. Test 50 checks the state of the PKP flag. If that flag is OFF, the program branches to test 140 and that test, as previously described, is taken. In addition, if the test 90 establishes that the ΔP flag is OFF, the program also branches to test 140 for the purposes previously described.

In the event that test 10 is positive (ΔA flag is ON), test 70 is negative (EP flag is OFF), test 110 is negative (PKP flag is OFF) and test 130 is positive (CHORD tab is ON), the program branches to test 160 which determines if an accompaniment key ("AA") has been added since the previous scan. If test 160 is negative, i.e., no accompaniment keys have been added since the previous scan, test 170 checks the state of the CID MEMORY tab. If the CID MEMORY tab is ON, the program branches to EXIT. However, if the CID MEMORY tab is OFF, test 180 checks AKP flag. If this flag is OFF, the program branches to test 150 for the purposes previously described. It should be noted that if test 180 is negative, no pedal note is sounded. On the other hand, if test 180 establishes that the AKP flag is ON, the program branches to EXIT.

In the event that test 160 establishes that the AA flag is ON and because the chord root can change only on an added accompaniment key, the CID system 190 of the present invention is activated. After CID is taken, the program branches to EXIT. The CID system will now be described in detail.

The CID system of the present invention has as its basis eleven (11) standard chords. For convenience, these standard chords are described in FIG. 3 as "C" chords. It should be recognized, however, that the CID system of the present invention is not limited merely to "C" chords; rather, the invention may be used with any chord.

Figures 3, 4, 5:
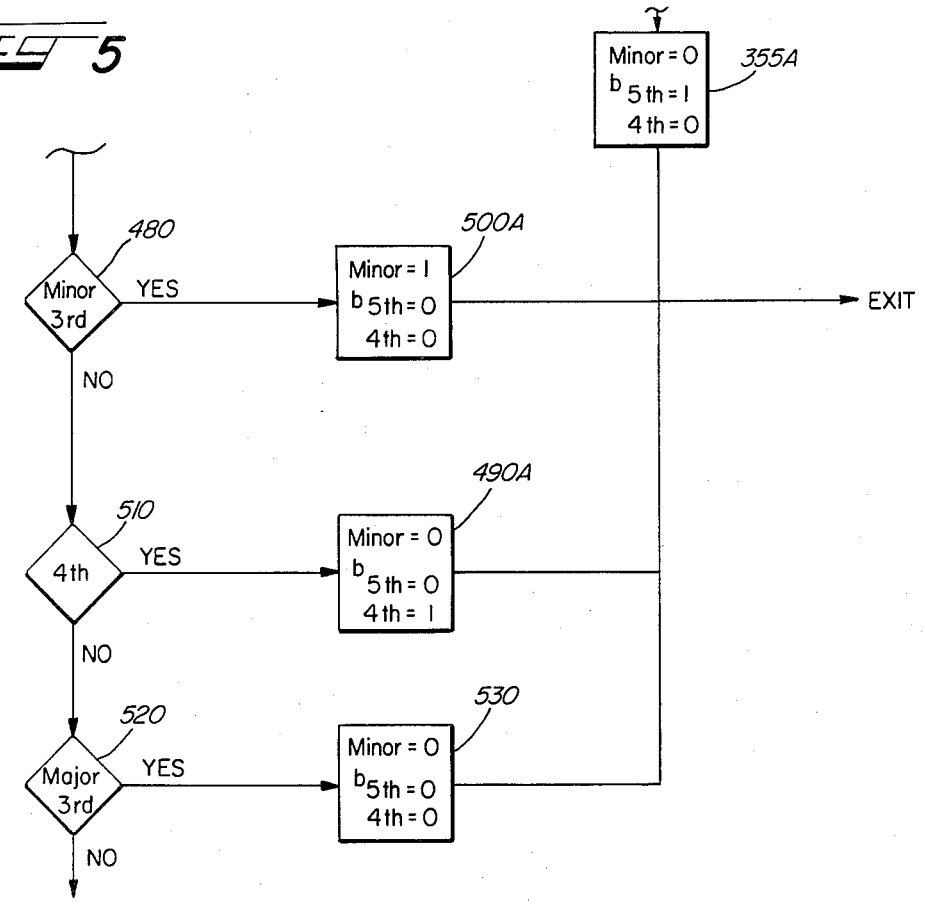
FIG. 3 is a depiction of eleven standard chords.
FIG. 4 is a flow chart depicting the process of the present invention and illustrating the manner in which the processor determines the chord type and root thereof being played for automatic control of the pedal keyboard.
FIG. 5 is a flow chart depicting an extension of the process of FIG. 4 for the identification of suspended chords.
Figure 4:
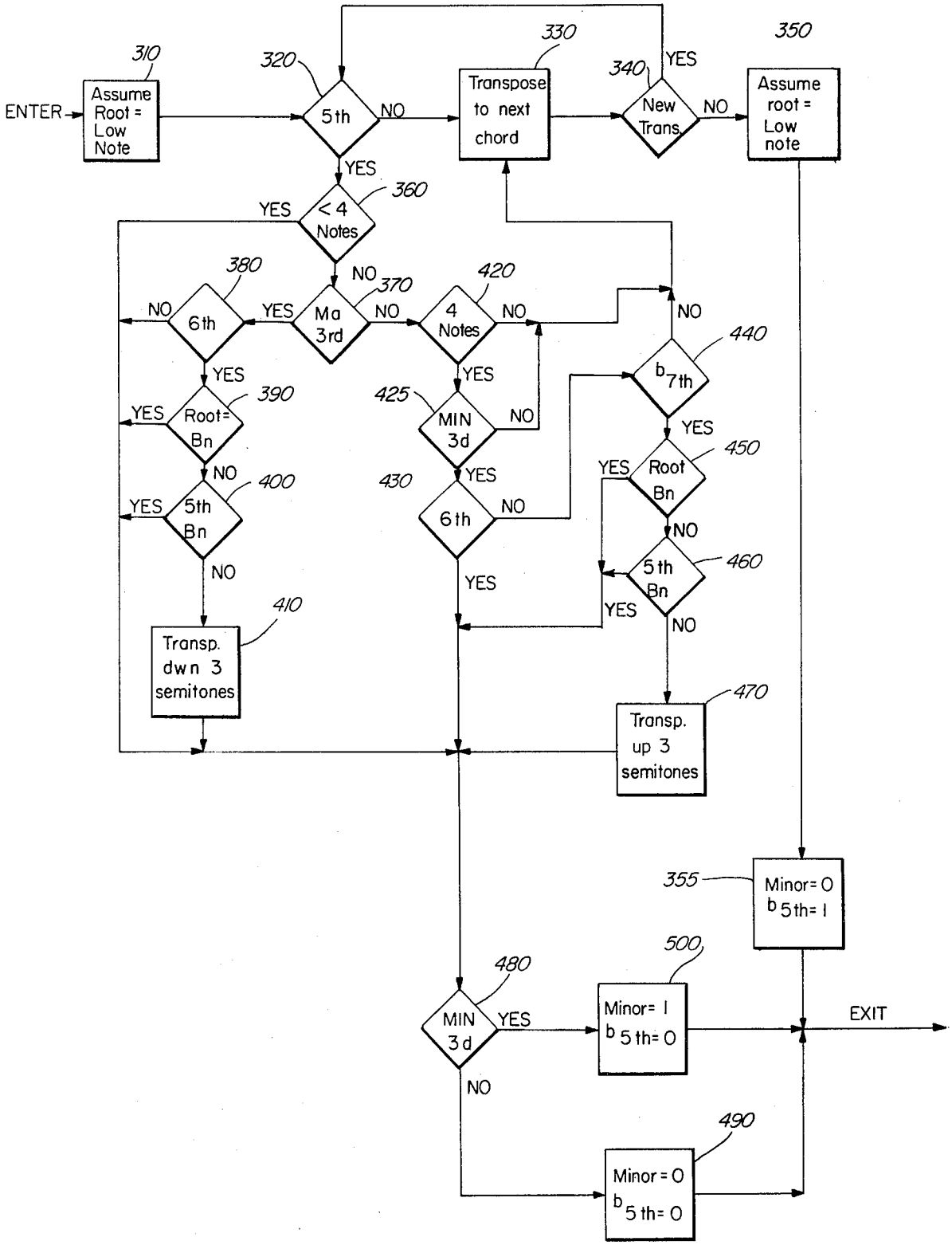

As shown in FIG. 3, the C major triad is comprised of C, E and G notes. In machine readable binary code, the C major triad, as shown in FIG. 3, may be written as "100010010000". It also should be noted that for simplicity the remaining standard chords shown in FIG. 3 are depicted in binary code form with the 0's excluded.

As one skilled in the art will appreciate, the standard chords identified in FIG. 3 can be divided into three groups as follows:

I. Chords with No Root Fifth Interval

1. C Augmented Triad; and
2. C Diminished Seventh.

The C Augmented Triad has three notes equally spaced on four semi-tone intervals. The C Diminished Seventh has four notes equally spaced on three semi-tone intervals.

II. Chords With One Root Fifth Interval

1. C Major Triad;
2. C Minor Triad;
3. C Dominant Seventh;
4. C Minor Sixth; and
5. C Diminished Ninth.

The chords in this group all have one root fifth interval.

III. Chords With Two Roots Fifth Pairs

1. C Minor Seventh;
2. C Major Seventh;
3. Major Sixth; and
4. C Dominant Ninth.

The chords in this group all have two pair of root fifth intervals. In the C Minor Seventh, the $B^b$ note is a fifth interval above the $E^b$. By transposing each note down three semi-tones, the $E^b$ becomes C; the G becomes E; the $B^b$ becomes G; and the C becomes A. The result of this transposition is a C Major Sixth chord. In other words, a C Minor Seventh is also an $E^b{}_6$. Correspondingly, a C Major Sixth is also an $A_{m7}$.

As one skilled in the art will also appreciate, the C Major Seventh chord also has two root fifth intervals. However, if the chord is transposed to the alternate root position, the chord would be a C Minor Triad with flatted sixth added, i.e., root, minor third, fifth and flatted sixth. This is not one of the standard chords and, accordingly, the C Major Seventh chord may be non-ambiguously identified by the CID process. Likewise, if the C Dominant Ninth chord is transposed up five semi-tones, the result is a C Minor Triad with both the fourth and sixth added; because this is not one of the standard chords, the C Dominant Ninth transposition may also be identified without ambiquity.

With the foregoing in mind, reference is now made to FIG. 4. When the CID system is activated, function 310 assumes that the root of the chord is the lowest, or bottom, note ("BN") in the played chord. With this assumption, test 320 checks to determine if there is a fifth interval note in the chord based upon the assumed root. If no fifth interval note exists for the assumed root, the chord is transposed and the next higher interval note is assumed to be the root. This transposition is made by transposition means 330. Means 330 contains a counter (not shown) which counts the number of rotations each time a search is made for a new transposition. Test 340 uses the value from this counter to determine if the transposition found is new, i.e. after 12 rotations the binary code has returned to the original inversion and the transposition would not be new at that point. If all chord transpositions are tested and no fifth interval note is found, the lowest note is assumed to be the root by the function 350. The flow path just described is that path followed by the chords of Group I, i.e., the Augmented Triad or the Diminished Seventh.

In addition to identifying the root of the chord to be automatically played by the pedal system, it is desirable to have the automatic pedal pattern play a sequence of notes compatible with the identified chord. This feature requires that the chord be identified as a major or minor chord. Because the Augmented Triad and the Diminished Seventh are not always played in the root position, function 355 sets the minor flag equal to 0 and the flatted fifth flag equal to 1. The result of this operation stores in memory the binary code for a flatted fifth rather than a major third or a minor third. Thereafter, the program exits the CID process.

In the event the test 320 determines that a fifth interval is present, test 360 is taken to determine if less than four notes are present. If this test is positive, a valid root for a Major Triad or a Minor Triad has been identified. In addition, if only a root fifth pair had been played, the correct root would also be determined.

Test 480 now determines if the chord is a major or minor chord. If test 480 is positive, the minor flag is set equal to 1 and the flatted fifth flag is set equal to 0 by function 500. If the test 480 is negative, the minor flag is set equal to 0 and the flatted fifth flag is also set equal to 0 by function 490 which results in the output of a major third chord. A major third is musically valid with either a Major Triad or a root-fifth pair. The CID process is exited from either of the functions 490 or 500.

If the test 360 is negative, a chord of four or more notes has been identified. Thus, it is necessary to determine the correct root fifth pair of either the Group II or Group III chords. This determination is commenced by test 370 which checks for a major third. If test 370 is positive, test 380 checks for a sixth. If no sixth is present, the chord can only be one of the major chords of Group II or the Dominant Ninth chord in the correct root position. Thus, in the event test 380 is negative, a Dominant Seventh, Major Seventh, Dominant Ninth or Diminished Ninth chord has been identified. Thereafter, test 480 is taken as previously described.

If test 380 is positive, only a Major Sixth or a transposed Minor Seventh could be present. Thus, test 390 checks to determine if the assumed root of the chord being tested is the lowest note. If this test is positive, the root assumed by function 310 is the preferred root and test 480 is taken as described.

If test 390 is negative, test 400 determines if the corresponding fifth of the chord being tested is the bottom note. If this test is positive, test 480 is taken as described. However, if test 400 is negative, it has been determined that a Minor Seventh is the preferred chord and the root is transposed down three semi-tones to correspond to the root of a Minor Seventh rather than a Major Sixth. This transportation is made by function 410. After such transposition, test 480 is taken as described.

If test 370 is negative, i.e., there is no major third, test 420 checks for the presence of four notes. If this test is negative, function 330 is addressed and a transposition of the chord occurs by function 330.

If test 420 is positive, test 425 checks for a minor third. If there is no minor third, transposition means 330 is addressed and a transposition of the chord occurs.

If the test 425 is positive, test 430 is taken to check for the presence of a sixth chord. If this test is positive, test 480 is taken as described. However, if test 430 is negative, test 440 determines whether a flatted seventh interval is present. If no flatted seventh interval is present, transposition means 330 is addressed and a transposition of the chord occurs.

If test 440 is positive, a Minor Seventh chord or a transposition of a Major Sixth chord has been identified. Test 450 checks to determine if the assumed root of the chord being tested is the bottom note; if test 450 is positive, test 480 is taken as described. However, if test 450 is negative, test 460 is taken to determine if the corresponding fifth of the chord being tested is the bottom note. If test 460 is positive, test 480 is taken as described.

Finally, if test 460 is negative, it has been determined that a Major Sixth chord is the preferred chord and the root is transposed up three semi-tones to correspond to the root of a Major Sixth rather than a Minor Seventh. This transposition occurs by function 470. Thereafter, test 480, as previously described, is taken.

As an example of the foregoing description of the CID system, consider the C Major Sixth chord which comprises the C, E, G, and A notes (see FIG. 3). If the chord is played with the C as the bottom note it is identified by the CID system as shown in Table II.

TABLE II

| Test | Result | Remarks |
|---|---|---|
| 320 | Positive | Root fifth interval identified |
| 360 | Negative | Four or more notes in chord |
| 370 | Positive | Major third identified |
| 380 | Positive | Sixth present |
| 390 | Positive | Root = BN; sixth identified |
| 480 | Negative | Major chord confirmed |

Likewise, consider the C Minor Seventh chord which comprises the C, D#, G and A# notes (see FIG. 3). If the chord is played with the G as the bottom note it is identified by the CID process as shown by Table III.

TABLE III

| TEST/ FUNC-TION | RESULT | REMARKS |
|---|---|---|
| 320 | Negative | Root fifth interval is not identified. |
| 330 | Transpose | This transposes chord one semitone. |
| 340 | Positive | New transposition found. |
| Repeat 320-330-340 | | This test/function sequence is iterated four more times until test 320 is positive. |
| 320 | Positive | Root fifth interval identified. |
| 360 | Negative | Four or more notes in chord |
| 370 | Negative | No major third identified |
| 420 | Positive | Four notes in chord |
| 425 | Positive | Minor third identified |
| 430 | Negative | No sixth present |
| 440 | Positive | Minor seventh identified |
| 450 | Negative | Assumed root not equal BN |
| 460 | Positive | Fifth = BN |
| 480 | Positive | Minor third identified; minor chord identified |

As previously noted, once the CID system has identified the chord being played on the manual keyboard, a signal may be generated for the synthesis of music on the pedal keyboard which is compatible with the identified chord. Such synthesis is fully and completely described in the Tone Generator System Application, the Harmony Generator Application, and the Chords and Sequences Patent, all of which are referred to above.

Those skilled in the art will recognize that the preferred embodiment described above can be extended to other less common chords. Thus, a so-called suspended chord can be identified. For example, a C suspended chord comprises a C root, a G fifth and an F fourth. If this chord were being played, the chord would be transposed in that loop of FIG. 4 containing functions 320, 330 and 340 until C or F appeared in the root position. Test 360 would then be taken because of the presence of G or C. Because of the presence of less than 4 notes, function 480 would be taken, followed by function 490. As discussed with respect to FIG. 4, the invention would identify a major third by setting both the minor and flatted fifth flags to zero.

In order to identify a suspended chord it is desirable to provide certain additional test sequences. These additional tests are depicted in FIG. 5, where function 480 is the same as that of FIG. 4. However, functions 355A, 490A and 500A are slight modifications of those disclosed in FIG. 4, where the ability to set a 4th flag is included. Tests 510 and 520 and flag setting routine 530 are also included. If the C/G-root/fifth pair is encountered first in the transposition sequence identified above, test 480 will be negative; test 510 will be positive because of the presence of the F, and function 490A will set the 4th flag. If the F/C-root/fifth pair is encountered first in the transposition sequence, tests 480, 510 and 520 will all be negative, and the program will return to the transposition sequence at function 330 (FIG. 4) and proceed until the C/G-root/fifth pair is encountered.

As can be seen by the above example, the general procedure can be extended to new chords as required by the type of music synthesis systems being serviced by CID. Thus, the general process of the present invention comprises iteratively transposing the chord to be identified until the number of notes and the interval relations of these notes match the chord types specified. If this is not possible, the lowest note is assumed to be the root and the chord type is identified based on that assumption. It should be appreciated that differing music synthesis systems may require more or less precise identification of the chord type.

Those skilled in the art will recognize that the preferred embodiments described above can be altered and modified without departing from the true spirit and scope of the invention as described above and defined in the following claims.

We claim:

1. A process for identifying the chord type and root represented by the actuation of one or more playing keys of a musical instrument keyboard capable of representing a group of chord types based on a group of roots, each of the playing keys corresponding to one note, said process employing a switch matrix and multiple-location memory and comprising the steps of:

scanning said switch matrix and comparing the state of the switches therein to the state of corresponding bits in said multiple-location memory;

selectively enabling a means for chord identification;

determining the chord type and the root of the chord being played by selectively iteratively transposing said chord whereby said chord is identifiable by the number of notes contained therein and the interval relationship thereof; and storing in said multiple-location memory said chord type and said root for processing, whereby said processing generates a signal for the synthesis of music which is compatible with the chord being played.

2. A process for identifying the chord type and root represented by the actuation of one or more playing keys of a manual keyboard of a musical instrument capable of representing a group of chord types based on a group of roots, each of the playing keys corresponding to one note, said process employing a switch matrix and multiple-location memory and comprising the steps of:

selectively enabling a means for chord identification;

selectively transposing the chord through an identifiable number of semi-tones;

determining the existence of a fifth interval in the chord being played on the manual keyboard;

selectively counting the number of notes being played on the manual keyboard;

selectively identifying the note intervals in the chord being played;

deriving a chord type; and generating a signal dependent upon the chord type, whereby said signal is available for the synthesis of music on a pedal keyboard which is compatible with the chord being played on the manual keyboard.

3. The process according to claims 1 or 2 wherein the enablement of said chord identification means is inhibited by the presence of a signal generated by the activation of at least one pedal key of the pedal keyboard of an electronic organ.

4. An apparatus for identifying the chord type and root note represented by the actuation of one or more playing keys of a musical instrument keyboard capable of representing a group of different chord types based on a group of different roots, each of said playing keys corresponding to one note, said apparatus employing a switch matrix and multiple-location memory and comprising:

means for iteratively scanning said playing keys and for storing a multi-bit data representation of said playing keys in said multiple-location memory means;

means for comparing the state of key switches of said switch matrix to the state of corresponding bits in said multiple-location memory and for repetitively updating the state of keyboard status flags;

means for selectively enabling a chord identification means;

means for determining the root of the chord being played by selectively iteratively transposing said chord through an identifiable number of semitones;

means for selectively counting the number of notes and for determining the interval relationship thereof in said chord and for identifying the chord type; and means for storing in said multiple-location memory said identified chord type and said root for processing, whereby said processing generates a signal for the synthesis of music which is compatible with the chord being played.

5. The apparatus according to claim 4, whereby said selectively enabling means is inhibited by the presence of a signal generated by the activation of at least one pedal key of the pedal keyboard of an electronic organ.

6. The apparatus according to claim 4 or 5, whereby all of said means are controlled by at least one microprocessor.

* * * * *

UNITED STATES PATENT AND TRADEMARK OFFICE

CERTIFICATE OF CORRECTION

PATENT NO. : 4,389,914

DATED : June 28, 1983

INVENTOR(S) : Dale M. Uetrecht and Carlton J. Simmons, Jr.

It is certified that error appears in the above—identified patent and that said Letters Patent is hereby corrected as shown below:

Col. 7, line 17, "3. Major Sixth; and" should be
--3. C Major Sixth; and--.

Col. 8, line 45, "transportation" should be --transposition--.

Signed and Sealed this

*Twentieth* Day of *September 1983*

[SEAL]

*Attest:*

GERALD J. MOSSINGHOFF

*Attesting Officer*

*Commissioner of Patents and Trademarks*